United States Patent [19]

Berlino

[11] 4,289,314

[45] Sep. 15, 1981

[54] WORD FORMING CHECKERS GAME METHOD

[76] Inventor: Gary M. Berlino, 5731 Yorkshire, Detroit, Mich. 48224

[21] Appl. No.: 969,671

[22] Filed: Dec. 15, 1978

Related U.S. Application Data

[63] Continuation of Ser. No. 806,994, Jun. 16, 1977, abandoned.

[51] Int. Cl.[3] ..... A63F 3/00

[52] U.S. Cl. ..... 273/260; 273/272

[58] Field of Search ..... 273/272, 260, 261, 242, 273/243; 35/35 H, 35 J

[56] References Cited

U.S. PATENT DOCUMENTS 1,203,473 10/1916 Branch ..... 273/272

3,642,286 2/1972 Moore ..... 273/243

FOREIGN PATENT DOCUMENTS 638243 6/1950 United Kingdom ..... 273/242

*Primary Examiner*—Richard C. Pinkham

*Assistant Examiner*—Scott L. Brown

*Attorney, Agent, or Firm*—Irving M. Weiner; Pamela S. Burt; John L. Shortley

[57] ABSTRACT

A word checkers game apparatus combining the tactics and maneuvering of a conventional checkers game with word forming skills and tactics. The game apparatus includes a checkers type of game board with alternating squares of first and second colors but with a larger number of such squares. Game playing pieces in the form of cubes having lettered faces are maneuvered by the players on the game board. The players in turn select a cube, inspect the faces of the cube and move it to form words. Points are obtained from the number of letters in the completed word(s).

1 Claim, 6 Drawing Figures

WORD FORMING CHECKERS GAME METHOD

This is a continuation of application Ser. No. 806,994, filed June 16, 1977 now abandoned.

BACKGROUND OF THE INVENTION

1. Field of the Invention

The present invention relates generally to a game apparatus combining the general game playing skills and tactics of checkers with novel word forming skills and tactics.

The terminology "checkers game" as employed herein is intended to connote the conventional game wherein two players maneuver game playing pieces on a playing surface divided into alternately colored square faces, with all play being conducted on spaces of one color, such as black. The players sit on opposite sides of the board and alternately move their pieces diagonally in a forward direction. Upon reaching the last rank of the board, pieces are "crowned" and kings may move both backwards and forwards diagonally. The object of the game is to eliminate opponent's playing pieces from play by "jumping" them.

In particular, the present invention relates to a game apparatus including a rectangular checkered playing surface and cube-shaped playing pieces having lettered faces.

2. Description of the Prior Art

Heretofore, there has not been developed any accepted game or game apparatus which includes the basic moves associated with a checkers game in combination with word forming tactics in an enjoyable manner. Because the basic moves of a checkers game are well known, it has been found desirable to combine such moves with word forming skills and tactics to provide an enjoyable and offtimes educational game apparatus.

Illustrative of prior art game apparatus of a word forming types are: the "GAME" disclosed in U.S. Pat. No. 810,631 issued in 1906 to S. F. Enos; the "GAME" disclosed in U.S. Pat. No. 1,591,639 issued in 1926 to E. R. McDonald; the "GAME" disclosed in U.S. Pat. No. 2,167,915 issued in 1939 to D. H. Sweet; and the "BOARD GAME APPARATUS" disclosed in U.S. Pat. No. 3,624,808 issued in 1971 to R. F. Anderson.

The above set forth prior art game attemps each include game concepts which provide for twenty-six playing pieces associated with each player, such as to represent the letters of the English alphabet. None of these attempts employ the basic game playing concepts of the conventional checkers game, and thus do not provide the desirable type of game apparatus discussed hereinabove, and as provided by the present invention. The present invention eliminates the shortcomings of prior art attempts in game apparatus by providing an educational and enjoyable combination of basic checkers game playing moves and word forming moves.

SUMMARY OF THE INVENTION

The present invention provides a competitive game apparatus including at least two contrasting sets of polyhedral game playing pieces for use on a substantially flat game board capable of rigidly supporting the sets of game playing pieces. The game board has a rectangular playing surface provided with a checkered pattern of spaces of first and second contrasting colors arranged alternately in horizontal and vertical rows. A plurality of the faces of each polyhedral playing piece are each provided with a different letter of the alphabet, and the playing pieces of the sets are adapted to be maneuvered individually about on the spaces of the first color on the game playing surface in general player-alternating checkers-game playing moves diagonally forward, or backward as well if crowned. The playing pieces of the sets are further adapted to be maneuvered to form words in conjunction with the checkers-game playing moves.

It is an object of the present invention to provide a novel game method wherein the polyhedral game playing pieces comprise cubes with each of the six faces thereof provided with a different letter of the alphabet. Each of the sets of game cubes are adapted to be placed on horizontal rows of playing spaces of the first color on opposite sides of the playing surface in general checkers-game starting position. The spaces of the playing surface comprise equally dimensioned squares, with the vertical rows including a greater number of squares than the horizontal rows.

In the preferred embodiment, two contrasting-color sets of playing cubes are provided and the game apparatus is adapted to be played by two players, each provided with one set of cubes. Each cube is adapted to be selectively disposed so that a desired one of the six different letters thereon will be exhibited on the upper horizontal face thereof to form words when the cube is maneuvered in one of the general checkers-game playing moves. The object of the game played with the apparatus is to score points by words formed with a maneuvered cube and to maneuver each said cube in checkers-game playing moves.

Other objects and details of the invention will become apparent from the following description, when read in conjunction with the accompanying drawings.

DETAILED DESCRIPTION OF PREFERRED EMBODIMENTS

Figure 1:
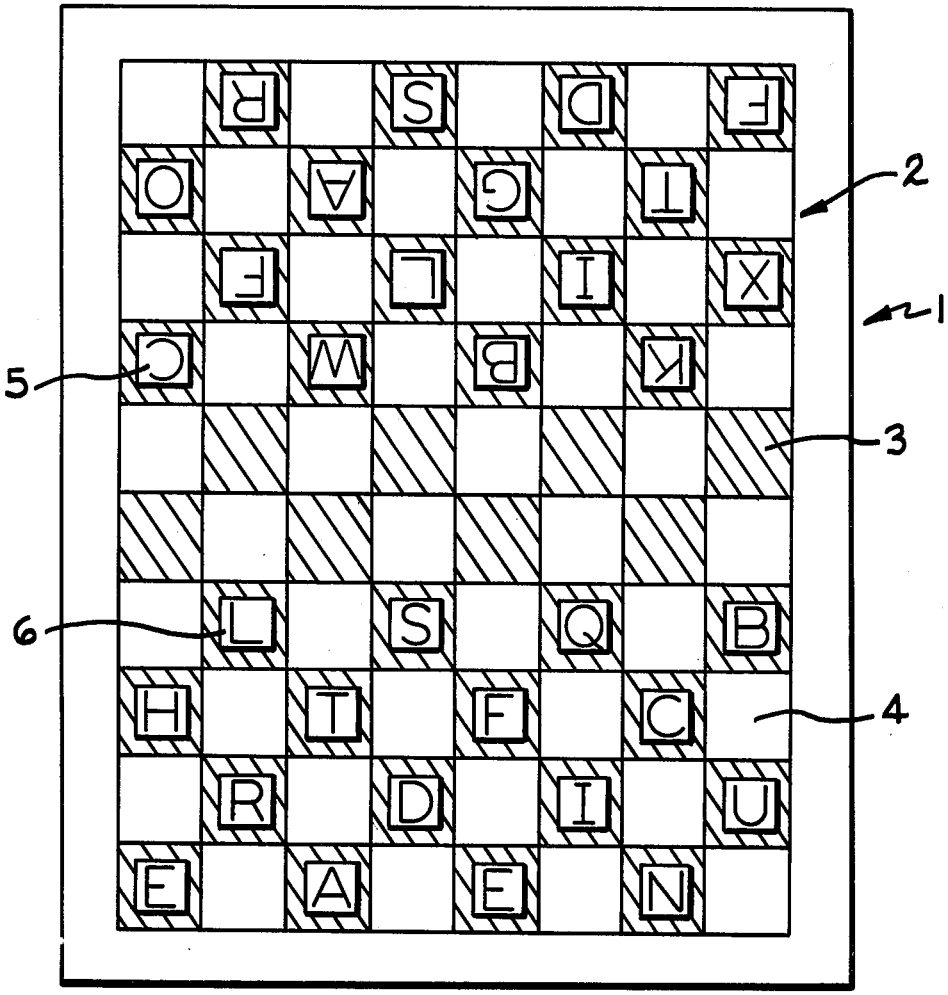
FIG. 1 depicts a top plan view of the game board having the playing cubes placed thereon in a game starting position in accordance with the invention.

With reference to FIG. 1, there is depicted a substantially flat and rigid game board 1 provided with a rectangular game playing surface 2. The playing surface 2 is provided with a checkered pattern of squares 3 of a first color such as black, and squares 4 of a second color such as red, arranged alternately in horizontal and vertical rows. It will be seen that the vertical rows each include ten squares, the horizontal rows each include eight squares, and a total of eighty squares are thus provided on the playing surface 2. In playing position, preferably the game board 1 will be disposed between two opposing players, with the players seated adjacent the opposite horizontal edges of the game board 1. It is contemplated that the game board 1 can be fabricated of any substantially rigid material such as cardboard, wood, plastic, etc., and can be adapted to fold in a conventional manner at the center thereof for ease in transporting and storing same. The playing surface 2 may comprise a directly painted surface on the board 1, or alternatively may comprise a separately prepared and patterned paper or plastic surface which is glued or otherwise affixed to the board 1.

Also depicted on the playing surface 2 are two sets of game playing cubes. It should be noted that the entire set of game playing cubes 5 of a first player are of a contrasting color to the entire set of game playing cubes 6 of an opposing second player. Each set of cubes 5 and 6 include 16 cubes, and the cubes are arranged on the black squares 3 of the playing surface 2. The game starting position of the cubes 5 and 6 depicted in FIG. 1 shows the cubes arranged on the black squares 3 starting with the first horizontal row closest to each player and then filling the black squares 3 of the first four horizontal rows. This arrangement is generally the same as conventional checkers game starting positions.

Figure 2:
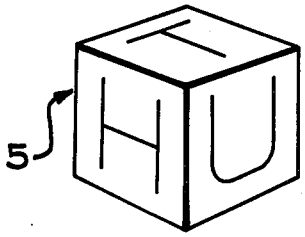
FIG. 2 illustrates a perspective view of a game playing cube in accordance with the invention.

With reference now to FIG. 2, the structure of the cubes 5, which are substantially identical, except for color, to the cubes 6, is depicted in greater detail. The cube 5 is depicted with three of its faces exposed exhibiting respectively the letters "H", "U", and "T". It should be noted that each of the six faces of the cubes are provided with a single letter of the alphabet, with no given letter appearing twice on the same cube. Each cube may include both consonants and vowels, and preferably each set of sixteen cubes will include cube faces provided with each of the letters of the alphabet to provide a full range of letters for play. As depicted in both FIGS. 1 and 2, the top horizontal face of the playing cubes 5 and 6 exhibits the particular letters employed in forming words during game play. In this connection, it should be noted that when a particular cube 5 or 6 is being maneuvered by a player during play, that cube becomes the "pivotal" cube, and the player is free to pivot the cube to exhibit on the top horizontal face thereof whichever of the six letters on the pivotal cube he finds most desirable for word formation use. This aspect of the present invention will be described more definitively hereinbelow.

To more clearly set forth the general tactics and offensive and defensive maneuvering employed in playing in accordance with the present invention, the general method of play will now be set forth.

In commencing the game, each player positions his set of cubes in the starting position indicated in FIG. 1, with the letters on the top horizontal faces thereof positioned to face each opposing player as in FIG. 1. Preferably, the letters are initially randomly positioned by the players, such as by merely lettting the cubes drop on the board as in the manner of dice, to randomly exhibit particular letters on the top horizontal faces of the cubes.

After the opposing sets of cubes 5 and 6 have been properly positioned in starting position as depicted in FIG. 1, each of the players may then perform their own respective initial game maneuvers. Such maneuvers comprise each of the players forming as many words as possible from his own set of cubes, without the displacement of any of the cubes or exhibited letters from their initial randomly selected positions.

It should be noted that certain restrictions are placed in word formation, both in the initial game maneuvers set forth above as well as throughout the remainder of the game. For example, the letters of the word must follow a diagonal path and must be in proper sequential order. Any diagonal path, such as zigzag, up, down, right or left may be followed, provided that words are formed by diagonally and adjacently disposed cubes. Only the letter exhibited on the upper horizontal face of each cube may be employed in word formation. A word may start and finish with any cube, however, after the initial game maneuvers and throughout the remainder of the game the "pivotal" cube must be incorporated at some position in the word. All words formed must be of three letters or more, and the only letters permitted for use in forming words, viz., the top horizontally disposed letters, can be employed only once in a given formed word. Other restrictions which may apply to word formation are: all words within a word are counted; letter reversals (discussed hereinbelow) are permitted; and the word must be found in a dictionary. Words which would not be acceptable would include prefixes, suffixes, contractions, hyphenated words, abbreviations (unless accepted as words such as memo, sz, etc.); words requiring an apostrophe; and all proper nouns.

It is most desirable both in initial maneuvers and throughout the game to form as many words as possible with the greatest possible number of letters because points are accorded on this basis. For example, a three letter word scores 3 points; a four letter word scores 5 points; a five letter word scores 8 points; a six letter word scores 15 points; and any word over six letters scores 15 points plus 5 points for each letter over six.

After the players have completed their initial maneuvers and corresponding points scored have been recorded, the actual physical maneuvering of the cubes commences. The first player moves a cube forward from his front row of cubes, and as in checkers, the cube can be maneuvered only forwardly on the black squares in a diagonal path, one square at a time. A player may only move his cube from its resident square to an unoccupied square, or alternatively may jump his opponent's cube onto an unoccupied square. Again, as in conventional checkers games, the players alternate their turns.

When an opponent's cube is jumped, or when a plurality of the opponent's cubes are jumped in a straight diagonal path or zigzag forward path, the cube or cubes jumped are "captured" and removed from the board, as in checkers. All possible jumps must be made or the opposing player takes the cube that had the possibility of jumping.

Each player attempts to maneuver his cubes from his own field onto his opponent's back line or rank to be "crowned." Having reached the back line or rank, the cube becomes a "King", and the opposing player puts a captured cube on top of the cube to be crowned to thus create a "crowned King." Upon acquiring a King status, a cube may be maneuvered either forwardly or rearwardly in a diagonal direction. Also, Kings may make jumps in any diagonal direction, either forwardly or rearwardly. The crowning procedure and resultant acquired powers are thus substantially the same as the crowning procedure in conventional checkers.

Throughout the above procedure, each time a player maneuvers his cube he is permitted to form words from adjacent cubes. When a cube is jumped the captured cube remains until words are formed, and the formed words can include the captured cube. Once the words are formed and points scored, or in the alternative if no words are possible, the captured cube is removed. When more than one jump is achieved, the last cube captured remains for making words and the previously captured cubes are removed immediately.

As briefly described hereinabove, each time a player maneuvers a cube on his turn, that particular cube becomes the "pivotal" cube. The pivotal cube can be placed on any of its six sides, with the letter exhibited on the top horizontal face thereof becoming the pivotal letter, the letter which is used to form all words on a particular move. Again, all words formed must include the pivotal cube, as well as the pivotal letter. On a crowned King cube, the top cube becomes the pivotal cube.

It will thus be seen that the object of the game is twofold, for each player to form words scoring as many points as possible, while at the same time maneuvering his cubes in conventional checkers game tactics and moves. When one player has no more cubes on the board, or is blocked against any further maneuvering, the game ends and the opponent winds the checkers game. Bonus points, such as 50 points, are awarded for winning the checkers game, and the points are added to the checkers game winner's score. It should be noted that the winner of the checkers portion of the game is not necessarily the overall winner, with the game winner being actually determined by the highest total number of points scored. It can thus be seen that combined offensive and defensive skills are required to form words and prevent an opponent from doing so, as well as to capture an opponent's cubes while preventing an opponent from doing so.

As an optional feature, because material advantage attends the first move of the game, before play commences each player may be permitted a specified number of transpositions to rearrange his letters and protect himself from his opponent's first move. For example, two such transpositions may be permitted for the player to move first, and three transpositions for the opposing player.

Figure 4:
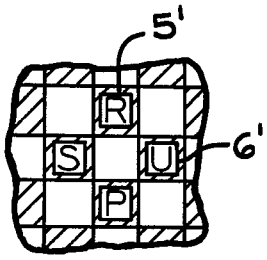
FIG. 4 illustrates an exemplary game playing situation in accordance with the invention.
Figure 5:
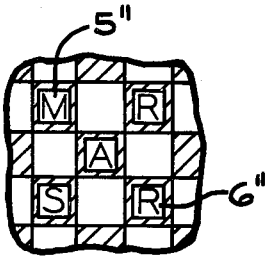
FIG. 5 depicts another exemplary game playing situation in accordance with the invention.
Figure 6:
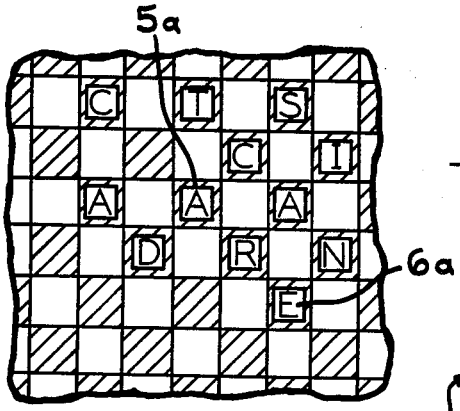
FIG. 6 illustrates a third exemplary game playing situation in accordance with the invention.

With reference to FIGS. 4–6, various exemplary playing situations are depicted. In FIG. 4, it can be seen that the word "S-P-U-R" is formed, including cubes 5', 6' from each player's set. Because no cube can be used more than once in the same word, however, the word "S-P-U-R-S" would not be permissible.

In FIG. 5, cubes 5'', 6'' from each players set are included in the formation of the words "M-A-R" and "R-A-M", since reversal of letters is permitted (assuming "M" to be the pivotal letter).

In FIG. 6, with cube **5*a* being the pivotal cube with the pivotal letter "A", the words "S-C-A-D", "C-A-D", "S-C-A-R-E", "S-C-A-R", "C-A-R-E", "C-A-R", "A-R-E", and "D-A-R-E" are formed, including the opponent's cube 6*a***. Other words, such as "C-A-N" are prohibited because they do not include the pivotal cube.

It should be further noted in the above examples, that although initially each player's cubes of his set are placed so that the letters face himself, at any point during the game the letters can be turned around for purposes of clarity in forming words. Generally, however, the letter's direction is inconsequential in that words can be easily formed with the letters faced in either direction without disturbing the players. If desired, however, an optional feature can be employed wherein each cube face is provided with two identical letters facing in opposite directions. This is not necessary, however, and generally may prove undesirable in that the added markings on the cubes provide more distractions to the eye.

Figure 3:
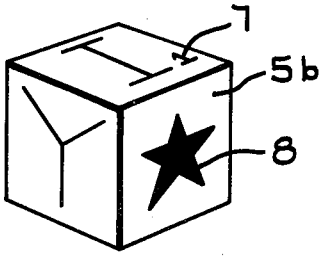
FIG. 3 depicts a perspective view of a game playing cube in accordance with a second embodiment of the invention.

The game apparatus as above described can be easily amended to include various optional modifications. For example, as depicted in FIG. 3, a playing cube **5*b***, as well as the other remaining cubes, can have provided thereon a small numerical subscript adjacent each letter to indicate a particular point value to correspond to each letter employed in forming a word. For example, the letter "I" might be worth 1 point, while the letter "Y" would be worth 5 points to the player.

In addition, a predetermined indicia, such as a star 8 on cube **5*b* in FIG. 3** may be provided on at least one cube in each player's set to serve as a "wild" letter to represent any desired letter of the alphabet, or in the alternative to provide bonus points.

Another optional feature would include time keeping means, such as an ordinary watch, a stop watch, an egg timer, etc., for use when a player's maneuvering time exceeds a practical limit such as when he has reached a standstill. For example, if the time keeping means is set for forming a word and the player makes a word within the alotted time, the timer is reset and the player's turn continues. If the player fails to make a word within the alotted time, it then becomes his opponent's turn. Normally, however, the timer would not be set for use when a player is in the process of choosing his pivotal letter.

Although there have been described above what are at present considered to be the preferred embodiments of the invention, it will be understood that various modifications may be made therein. The present embodiments are therefore to be considered in all respects as illustrative, and not restrictive. The scope of the invention is indicated by the appended claims rather than by the foregoing description.

I claim:

1. A competitive game playing method comprising the steps of:

placing a plurality of game playing pieces, each of which includes a plurality of faces each face being provided with a letter of the alphabet, with a significant number of alphabet letters being provided on the various faces and more than one different letter being provided on the various faces of each of the plurality of playing pieces, on a game playing surface having a checkered pattern of spaces;

in every second space in four laterally arranged rows with each row being offset one space from an adjacent row and being diagonally related to adjacent rows, and in two opposed sets of rows, with one letter on each piece facing upwardly;

selecting alternately in turn with an opponent, one of said pieces as a pivotal piece by inspecting more than one face of at least one piece and selecting one of said letters on one of said faces on one of said pieces to be a pivotal letter and arranging the latter said piece on said board with the selected pivotal letter facing upward;

moving said pivotal piece along a diagonal line on said surface toward opposing or friendly pieces into an open space in which said pivotal piece will be in a position in respect to the latter of said pieces wherein words in which said pivotal piece pivotal letter plays a part will be formed with a series of letters on adjacently positioned pieces along diagonal paths; and observing the number of words so formed on each such move and recording a total value thereof in accordance with a prearranged numerical value related to the number of letters in each observed word.

* * * * *